US006484338B1

(12) United States Patent
Hagglund

(10) Patent No.: US 6,484,338 B1
(45) Date of Patent: Nov. 26, 2002

(54) MATTRESS STRUCTURE

(75) Inventor: John E. Hagglund, Newberg, OR (US)

(73) Assignee: Tualatin Sleep Products, Inc., Tualatin, OR (US)

( * ) Notice: Subject to any disclaimer, the term of this patent is extended or adjusted under 35 U.S.C. 154(b) by 15 days.

(21) Appl. No.: 09/704,368

(22) Filed: Oct. 31, 2000

(51) Int. Cl.[7] ..... A47C 27/05
(52) U.S. Cl. ..... 5/716; 5/654.1
(58) Field of Search ..... 5/716, 718, 654.1, 5/210, 230, 235, 246, 257

(56) References Cited

U.S. PATENT DOCUMENTS 2,925,856 A 2/1960 Gleason
3,099,021 A 7/1963 Wetzler
4,907,309 A * 3/1990 Breckle ..... 5/718
5,048,167 A 9/1991 Heffley et al.
5,222,264 A * 6/1993 Morry ..... 267/81
5,467,488 A 11/1995 Wagner
5,469,590 A 11/1995 Simon
5,687,439 A * 11/1997 Wagner ..... 5/717
5,832,551 A 11/1998 Wagner
6,023,803 A 2/2000 Barman

* cited by examiner

*Primary Examiner*—Lynne H. Browne
*Assistant Examiner*—Fredrick Conley
(74) *Attorney, Agent, or Firm*—John Smith-Hill; Smith-Hill and Bedell

(57) ABSTRACT

An innerspring unit for a mattress is manufactured by inserting a resilient element into the passage between each two adjacent rows of springs of the innerspring unit. The height dimension of the resilient element is greater than the distance between the upper and lower spring retainer structures of the innerspring unit, whereby the resilient element remains partially compressed heightwise between the spring retainer structures.

17 Claims, 2 Drawing Sheets

MATTRESS STRUCTURE

BACKGROUND OF THE INVENTION

This invention relates to a mattress structure and in particular to an improved method of manufacturing an innerspring unit for a mattress.

The conventional mattress includes an innerspring unit, a top cover assembly and a bottom cover assembly. The innerspring unit includes coil springs arranged in linear rows. Each two adjacent coil springs are attached to one another at top and bottom by spring retainer elements.

The top and bottom cover assemblies are each composed of multiple layers of resilient foam material and an outer layer of fabric.

Generally, the mattress provides a balance between two potentially conflicting qualities. The mattress should be firm enough to provide adequate support and should be soft enough that it will not be uncomfortable. For many years, the goal of firmness dominated the mattress industry but more recently the desire for comfort has gained ground. Firmness and softness are each aspects of resilience or elasticity, i.e. the capability of a strained body to recover its size and shape after deformation.

In the conventional innerspring mattress, firmness is provided by the coil springs of the innerspring unit and softness is provided by the foam layers of the top and bottom cover assemblies. If the foam layers of the top cover assembly of a mattress are relatively thin, relatively little load is absorbed by the top cover assembly and most of the load is absorbed by the innerspring unit. In this case, the mattress will feel firmer rather than softer. The mattress might even be termed hard. If the foam layers of the top cover assembly are thicker (for a given resilience), more load will be absorbed by the top cover assembly and less by the innerspring unit, and the mattress will feel softer. However, it is not desirable that the cover assemblies be too thick because a degree of firmness and support is desirable.

As a user applies increasing weight to a conventional innerspring mattress, the weight is first taken up by the deformation of the foam layers of the top cover assembly, and when the foam layers of the top cover assembly are fully compressed, further increase in weight is taken up by the innerspring unit. The user can feel a sudden transition between the softness of the foam layers and the firmness of the innerspring unit, and this can cause the user to feel that in fact the mattress offers little in the way of comfort.

U.S. Pat. No. 5,048,167 discloses a method for restoring a used mattress in which blocks of resilient foam are inserted between the rows of coil springs of an innerspring unit using a tool that forces deformed or displaced springs to their proper positions. U.S. Pat. No. 5,048,167 teaches that in the event that the space between two rows of coil springs has a total height of five inches and a width of two inches, the foam block also should have a height of five inches and a width of two inches. Thus, if the coil springs are in a relaxed state, so that they are not compressed heightwise, the foam block also is relaxed and is not compressed heightwise.

SUMMARY OF THE INVENTION

In accordance with a first aspect of the invention there is provided an improved method of manufacturing an innerspring unit for a mattress, wherein the innerspring unit includes upper and lower spring retainer structures in substantially parallel confronting relationship and spaced apart at a predetermined distance, and a plurality of coil springs positioned between and attached to the spring retainer structures, the coil springs being arranged in a plurality of linear rows that are mutually parallel and are spaced apart perpendicular to the length of the rows, whereby a passage is formed between each two adjacent rows of coil springs, wherein the improvement comprises, for each two adjacent rows of springs, providing a resilient element having a height dimension, wherein the height dimension of the resilient element, in a relaxed state, is greater than said predetermined distance, and inserting the resilient element into the passage between the adjacent rows of springs with the resilient element oriented so that the height dimension of the resilient element is substantially perpendicular to the upper and lower spring retainer structures, whereby the resilient element remains partially compressed heightwise between the spring retainer structures.

In accordance with a second aspect of the invention there is provided a method of manufacturing a mattress, comprising providing an innerspring unit that includes upper and lower spring retainer structures in substantially parallel confronting relationship and spaced apart at a predetermined distance, and a plurality of coil springs positioned between and attached to the spring retainer structures, the coil springs being arranged in a plurality of linear rows that are mutually parallel and are spaced apart perpendicular to the length of the rows, whereby a passage is formed between each two adjacent rows of coil springs, providing a resilient element having a height dimension, wherein the height dimension of the resilient element, in a relaxed state, is greater than said predetermined distance, and inserting the resilient element into the passage between the adjacent rows of springs with the resilient element oriented so that the height dimension of the resilient element is substantially perpendicular to the upper and lower spring retainer structures, whereby the resilient element remains partially compressed heightwise between the spring retainer structures.

In accordance with a third aspect of the invention there is provided an innerspring unit for a mattress, including upper and lower spring retainer structures in substantially parallel confronting relationship and spaced apart at a predetermined distance, a plurality of coil springs positioned between and attached to the spring retainer structures, the coil springs being arranged in a plurality of linear rows that are mutually parallel and are spaced apart perpendicular to the length of the rows, whereby a passage is formed between each two adjacent rows of coil springs, and a plurality of resilient elements each having a height dimension, wherein the height dimension of the resilient element, in a relaxed state, is greater than said predetermined distance, wherein the resilient elements are disposed in the passages respectively and are oriented so that the height dimension is substantially perpendicular to the upper and lower spring retainer structures, whereby the resilient elements are partially compressed heightwise between the spring retainer structures.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
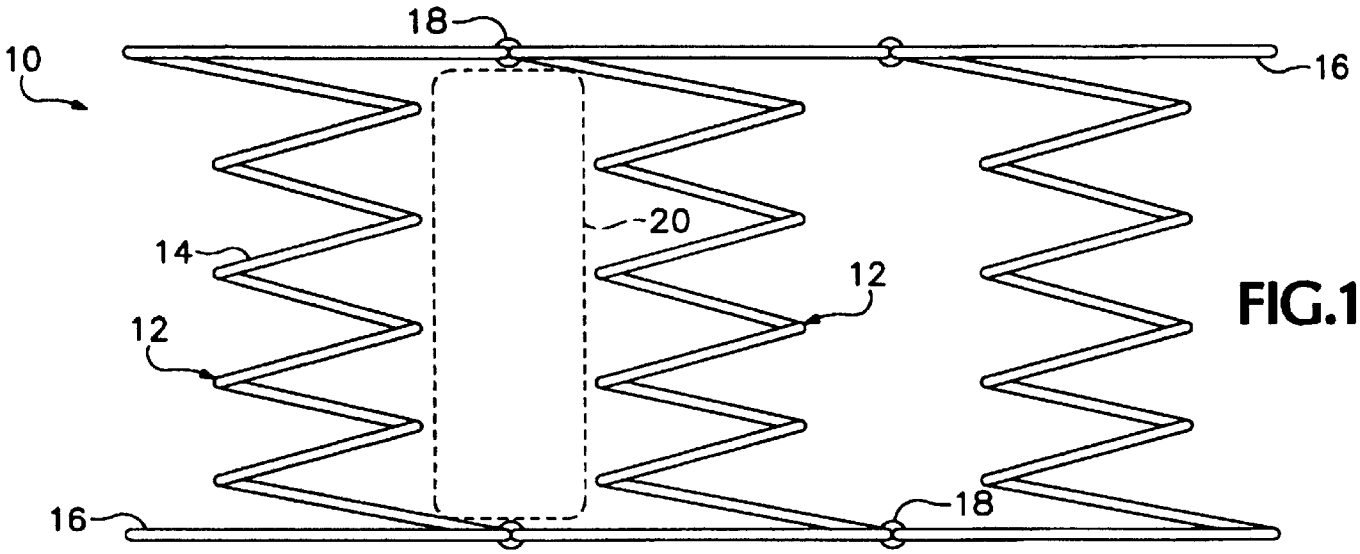
FIG. 1 is a partial sectional view of a mattress at a first stage in manufacture by a method in accordance with the present invention.

FIG. 1 illustrates an innerspring unit 10 that includes several rows of coil springs 12. Each coil spring 12 has a barrel 14 of uniform diameter and containing several turns of the coil spring and a head and base 18 of larger diameter than the barrel. It will be appreciated that the designations head and base are merely for convenience, since if the innerspring unit were turned over the head of a coil spring would become the base of the coil spring. Nevertheless, for convenience, the designations head and base will be applied.

The heads of each two adjacent coil springs are attached to one another by wire elements 18 and similarly the bases of each two adjacent coil springs are attached to each other by wire elements. The innerspring unit is shown in FIG. 1 in the configuration in which no external force is applied to the innerspring unit and the only significant force tending to compress the springs is the weight of the springs themselves.

The principal functional part of each coil spring, with respect to taking up load applied to a mattress including the innerspring unit, is the barrel of the spring. The head and base of the spring and the wire elements 18 serve as upper and lower spring retainer structures that retain the barrels of the springs in the proper relative positions. Thus, the spring retainer structures are structurally integrated with the springs themselves. It will be appreciated, however, that it is not necessary that the spring retainer structures be structurally integrated with the coil springs, and that the coil springs could be attached to discrete upper and lower spring retainer structures.

Figure 2:
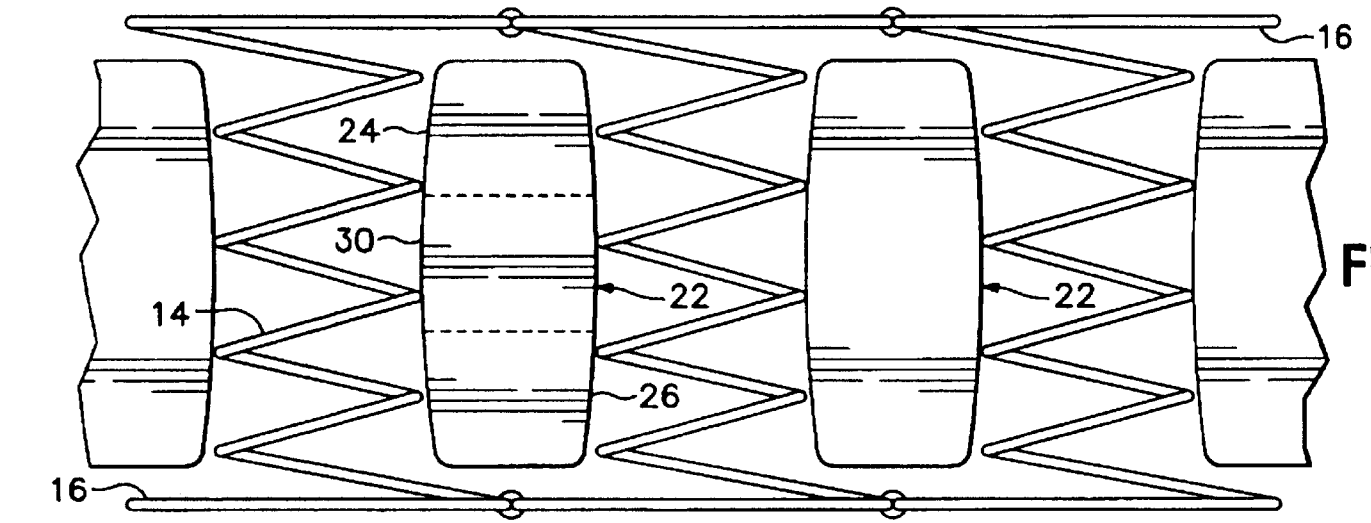
FIG. 2 is a similar view at a second stage of manufacture of the mattress.

A generally rectangular passage 20 is provided between the barrels of the springs in each two adjacent rows of springs. The passage 20 is bounded at top and bottom by the upper and lower spring retainer structures and is bounded laterally by the barrels of the adjacent rows of coil springs. Referring to FIG. 2, a resilient foam element 22 is inserted in each passage 20. The resilient element is preferably of composite structure, as will be explained in further detail below. In the relaxed state of the resilient element, the height of the element is greater than the height of the passage between the base and head of the springs. In FIG. 2, the elements 22 are shown in a vertically compressed state in order to facilitate insertion in the passages.

After the resilient foam elements have been inserted in the innerspring unit, the elements are released from compression. The innerspring unit is placed on top of a lower cover assembly 32 (FIG. 3) and an upper cover assembly 34 is placed on top of the innerspring unit. A peripheral wall (not shown) is fitted around the innerspring unit in conventional fashion and is attached to the fabric layers of the upper and lower cover assemblies. The mattress is thereby completed.

Figure 3:
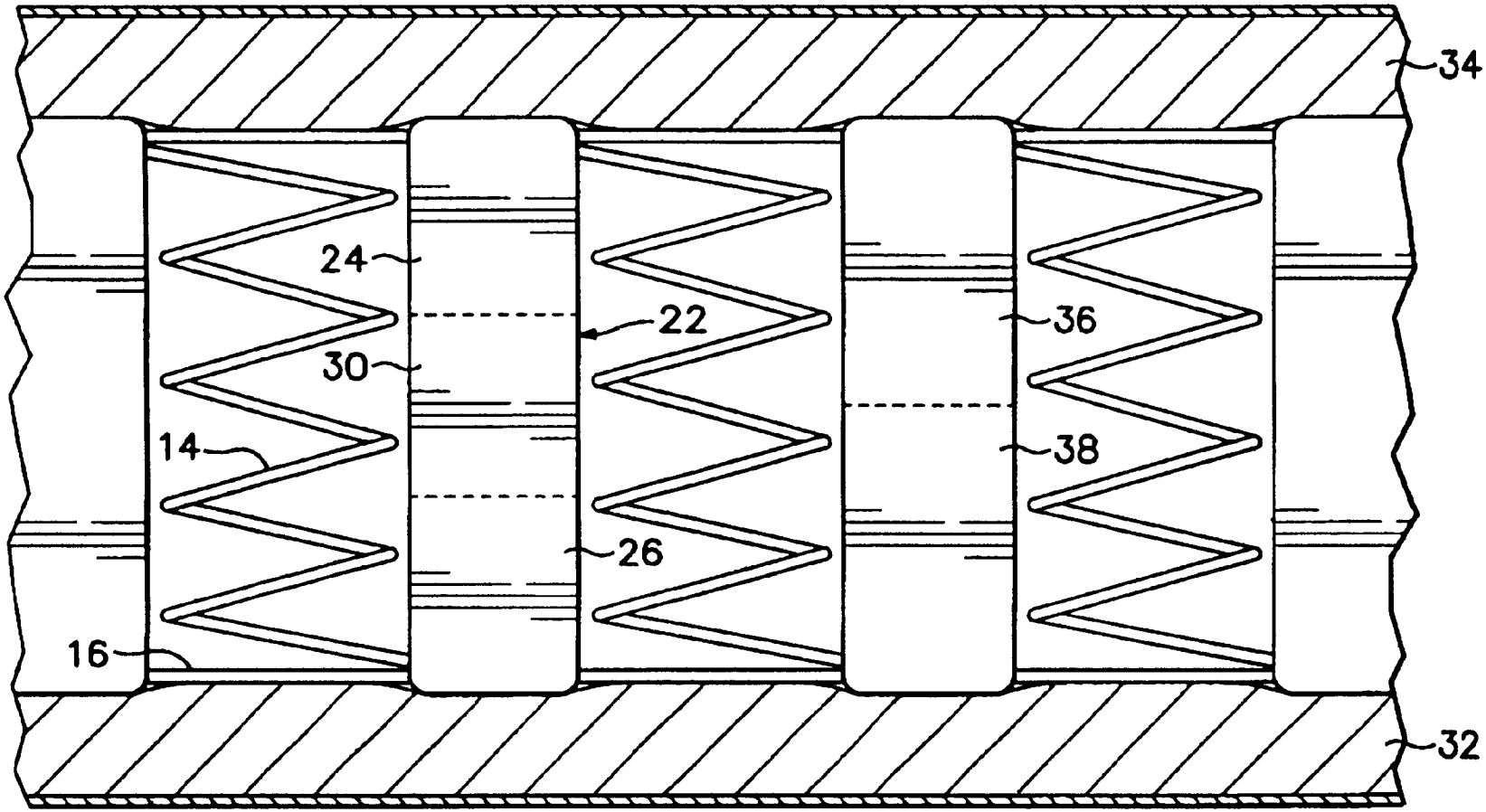
FIG. 3 is a similar view at a third stage of manufacture of the mattress.

When the resilient elements are released from compression, they expand vertically and tend to force the heads and bases of the springs apart, placing the coil springs 12 under tension. Further, the foam elements bulge upwards in the spaces between the heads of adjacent springs and bulge downwards in the spaces between the bases of adjacent springs, as shown in FIG. 3. Naturally, when the mattress is placed on a hard surface, the weight of the mattress compresses not only the foam layers of the lower cover assembly but also the foam elements to the extent that they bulge downwards below the bases of the coil springs.

When a user applies increasing weight to the mattress, the load is applied initially to compressing the foam layers of the upper cover assembly, as is conventional, and to compressing the foam element 22 to the extent that it bulges upwards beyond the heads of the coil springs. As the load increases, it is taken up by further compressing the resilient elements, and load is not taken up by the coil springs until the resilient elements have been compressed to the extent that the coil springs are no longer under tension. Accordingly, the mattress feels softer than the conventional innerspring mattress yet it nevertheless provides full support. Further, the transition between the state in which the load is being taken up by the foam layers of the top cover assembly and the state in which the load is taken up by the coil springs takes place over a range of loads, as the resilient elements are compressed, and therefore the user does not feel a sudden reduction in softness of the mattress when the foam layers of the upper cover assembly are fully compressed, as in the conventional innerspring mattress. Further, the resilient elements dampen the resilience or "bounce" of the coil springs, and stabilize the coil springs so that lateral force applied to one coil spring is not propagated throughout the innerspring unit.

Although yieldable under the weight of the user of the mattress, the resilient elements are nevertheless quite tough. Since there is a resilient element between each two adjacent rows of springs, the resilient elements stabilize the springs and resist their being forced out of place.

The resilient element 22 may be compressed vertically prior to insertion in the innerspring unit, for example with a tool similar to that disclosed in U.S. Pat. No. 5,048,167. Alternatively, the element may be held in a compressed state by wrapping in shrink wrap film. The shrink wrap film is removed after the element has been inserted in the innerspring unit. A third possible technique for inserting the resilient element is to insert a gripping tool through the passage, attach an end of the gripping tool to an end of the resilient element, and then withdraw the tool from the passage, pulling the resilient element into the passage.

It was mentioned above that the resilient foam element 22 may be of composite structure. Referring to FIGS. 2 and 3, the foam element may be composed of upper and lower layers 24 and 26 that are more yieldable then the intermediate layer 30. Referring to FIG. 3, the foam element may be composed of a softer element 36 and a firmer element 38. In this case, it is intended that the mattress be disposed with the softer element upwards and not be turned periodically, as is the practice with conventional mattresses.

It will be appreciated that the invention is not restricted to the particular embodiment that has been described, and that variations may be made therein without departing from the scope of the invention as defined in the appended claims and equivalents thereof. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated.

What is claimed is:

1. An improved method of manufacturing an innerspring unit for a mattress, wherein the innerspring unit includes upper and lower spring retainer structures in substantially parallel confronting relationship and spaced apart at a predetermined distance, and a plurality of coil springs positioned between and attached to the spring retainer structures, the coil springs being arranged in a plurality of linear rows that are mutually parallel and are spaced apart perpendicular to the length of the rows, whereby a passage is formed between each two adjacent rows of coil springs, wherein the improvement comprises, for each two adjacent rows of springs, providing a resilient element having a height dimension, wherein the height dimension of the resilient element, in a relaxed state, is greater than said predetermined distance, and inserting the resilient element into the passage between the adjacent rows of springs with the resilient element oriented so that the height dimension of the resilient element is substantially perpendicular to the upper and lower spring retainer structures, whereby the resilient element remains partially compressed heightwise between the spring retainer structures.

2. A method according to claim 1, wherein the resilient element comprises a composite bar of resilient foam material.

3. A method according to claim 1, wherein the step of inserting the resilient element includes:

compressing the resilient element heightwise to a height less than said predetermined distance, and permitting the resilient element to expand heightwise.

4. A method according to claim 1, wherein the resilient element comprises a composite bar composed of first and second elements of foam material, the first element being firmer than the second element.

5. A method according to claim 1, wherein the resilient element comprises a composite bar including upper and lower layers of foam material, the upper layer being more yieldable than the lower layer.

6. A method according to claim 1, wherein the resilient element comprises a composite bar including upper, intermediate and lower layers of foam material, the upper and lower layers being more yieldable than the intermediate layer.

7. A method of manufacturing a mattress, comprising:

providing an innerspring unit that includes upper and lower spring retainer structures in substantially parallel confronting relationship and spaced apart at a predetermined distance, and a plurality of coil springs positioned between and attached to the spring retainer structures, the coil springs being arranged in a plurality of linear rows that are mutually parallel and are spaced apart perpendicular to the length of the rows, whereby a passage is formed between each two adjacent rows of coil springs, and, for each two adjacent rows of springs:

providing a resilient element having a height dimension, wherein the height dimension of the resilient element, in a relaxed state, is greater than said predetermined distance, and inserting the resilient element into the passage between the adjacent rows of springs with the resilient element oriented so that the height dimension of the resilient element is substantially perpendicular to the upper and lower spring retainer structures, whereby the resilient element remains partially compressed heightwise between the spring retainer structures.

8. A method according to claim 7, wherein the resilient element comprises a composite bar of resilient foam material.

9. A method according to claim 7, wherein the step of inserting the resilient element includes:

compressing the resilient element heightwise to a height less than said predetermined distance, and permitting the resilient element to expand heightwise.

10. A method according to claim 7, wherein the resilient element comprises a composite bar composed of first and second elements of foam material, the first element being firmer than the second element.

11. A method according to claim 7, wherein the resilient element comprises a composite bar including upper and lower layers of foam material, the upper layer being more yieldable than the lower layer.

12. A method according to claim 7, wherein the resilient element comprises a composite bar including upper, intermediate and lower layers of foam material, the upper and lower layers being more yieldable than the intermediate layer.

13. An innerspring unit for mattress, including:

upper and lower spring retail structure in substantially parallel confronting relationship and spaced apart at a predetermined distance, a plurality of coil 5 positioned between and attached to the spring retainer structures, the coil springs being arranged in a plurality of linear rows that are mutually parallel and are spaced apart perpendicular to the length of the rows, whereby a passage is formed between each two adjacent rows of coil springs, and a plurality of resilient elements each having a height dimension, wherein the height dimension of the resilient element, in a relaxed state, is greater than said predetermined distance, wherein a resilient element is disposed in each passage and the resilient elements are oriented so that the height dimension is substantially perpendicular to the upper and lower spring retainer structures, whereby the resilient elements are partially compressed heightwise between the spring retainer structures.

14. An innerspring unit according to claim 13, wherein each resilient element comprises a composite bar of resilient foam material.

15. An innerspring unit according to claim 8, wherein the composite bar comprises first and second elements of foam material, the first element being firmer than the second element.

16. An innerspring unit according to claim 8, wherein the composite bar includes upper and lower layers of foam material, the upper layer being more yieldable than the lower layer.

17. An innerspring unit according to claim 8, wherein the composite bar includes upper, intermediate and lower layers of foam material, the upper layer being more yieldable than the intermediate layer.

* * * * *

UNITED STATES PATENT AND TRADEMARK OFFICE

CERTIFICATE OF CORRECTION

PATENT NO. : 6,484,338 B1
DATED : November 26, 2002
INVENTOR(S) : John E. Hagglund It is certified that error appears in the above-identified patent and that said Letters Patent is hereby corrected as shown below:

Column 6,
Line 23, “retail” should be deleted and replaced with -- retainer --.
Line 26, “5” should be deleted and replaced with -- springs --.
Line 45, “8” should be deleted and replaced with -- 14 --.
Line 49, “8” should be deleted and replaced with -- 14 --.
Line 53, “8” should be deleted and replaced with -- 14 --.

Signed and Sealed this

Twenty-fifth Day of March, 2003

JAMES E. ROGAN
*Director of the United States Patent and Trademark Office*